US006029880A

United States Patent [19]

Primot

[11] Patent Number: 6,029,880

[45] Date of Patent: Feb. 29, 2000

[54] METHOD FOR ASSEMBLING ARMATURES FOR CONCRETE PRODUCTS AND INSTALLATION FOR IMPLEMENTING IT

[75] Inventor: Gilles Primot, 14, rue du Petit Chaast, 10190 Bucey en Othe, France

[73] Assignee: Gilles Primot, Bucey en Othes, France

[21] Appl. No.: 08/894,814

[22] PCT Filed: Feb. 29, 1996

[86] PCT No.: PCT/FR96/00318

§ 371 Date: Aug. 29, 1997

§ 102(e) Date: Aug. 29, 1997

[87] PCT Pub. No.: WO96/27462

PCT Pub. Date: Sep. 12, 1996

[30] Foreign Application Priority Data

Mar. 3, 1995 [FR] France ..... 95 02500

[51] Int. Cl.[7] ..... B23K 31/02; B23K 37/02

[52] U.S. Cl. ..... 228/102; 228/105; 228/9; 228/7

[58] Field of Search ..... 228/7, 9, 102, 228/105

[56] References Cited

FOREIGN PATENT DOCUMENTS 1602627 6/1970 Germany ..... 228/9
1763895 11/1972 Germany ..... 228/7
3538720 A1 5/1987 Germany ..... 228/7
6-320294 11/1994 Japan ..... 228/7

OTHER PUBLICATIONS

Dr.–Ing. Joachim Wernicke, "Automated Concrete Factory: The Forming Robot Closes the Circle," *Betonwerk & Fertigteil–Technik* (Jun. 1988) XP 000568790, pp. 51–54.

*Patent Abstracts of Japan*, vol. 95, No. 001, & JP, A, 07–009129 (Jan. 1995).

*Patent Abstracts of Japan*, vol. 12, No. 138 (p–695)(Apr. 1988), & JP, A, 62–259107 (Nov. 1987).

*Primary Examiner*—Patrick Ryan
*Assistant Examiner*—Jeffrey T. Knapp
*Attorney, Agent, or Firm*—Chapman and Cutlter

[57] ABSTRACT

A method for preparing and assembling a planar reinforcement for a concrete element according to a pre-determined design plan, wherein a full-sized plan including the position and type of each element in the reinforcent to be achieved is mapped onto a working surface (30) having two reference directions, a suitable reinforcement element is positioned in each of a plurality of crossing points. The method is characterised in that one or both of the mapping and assembling operations are performed by a tool attached to the carriage of a robot (10), said carriage (10) having at least two degrees of freedom parallel to the reference directions. The method further comprises storing all the design plan data in a storage area of the robot, and using the robot to move the carriage (10) automatically in accordance with said data.

23 Claims, 9 Drawing Sheets

12

11
12

11
51
52
53
54
55
56

METHOD FOR ASSEMBLING ARMATURES FOR CONCRETE PRODUCTS AND INSTALLATION FOR IMPLEMENTING IT

The invention concerns the preparation and the assembly of metal armature elements for reinforcing construction elements or products to be made from so-called "reinforced concrete".

The structure of a construction to be built is conventionally designed by a design office which determines the characteristics (constitution and geometry) of the framework (and therefore of the armatures) to be integrated into each element (panel, slab, pre-slab, etc) of the construction, in particular in consequence of strength of materials calculations. These characteristics are embodied in a design drawing.

The basic elements of an armature are reinforcing rods of various diameters and the design of the armature of planar elements to be made from reinforced concrete can specify the use of a great variety of such reinforcing rods to achieve appropriate reinforcement of each area of each planar element (for example, the reinforcement must obviously be greater over a door in a vertical panel than in a solid area with no openings). The reinforcement in each area must be sufficient to guarantee good mechanical strength but with a sufficiently moderate safety factor so as not to lead to an unnecessarily excessive armature. Furthermore, this requirement for reinforcement in principle differs in various directions of any planar element (for example in the horizontal and vertical directions of a vertical panel).

Optimal reinforcement of a given planar element consequently justifies choosing reinforcing rod types, diameters, numbers and spacings that can vary significantly from one area to another.

The usual preparation and assembly procedures do not lend themselves to great complexity in the armature of any particular element.

A first option is for the armature elements to be laid out and assembled on site, in the shuttering to receive the concrete or in its immediate vicinity, using a reduced scale drawing supplied to the foreman of the armature team. The position of the armatures is marked out with reference to the dimensions on the drawings using meter rules or ten-meter rules, and then drawn out manually using industrial chalk. When the armature element is complex, a full-scale drawing is sometimes made on a concreted area, representing the characteristic points of the shuttering. This process is long and difficult (in particular as it implies various checks), in particular given the environment on the site and the fact that the laying out of the armatures (or "ironwork") is a job that is generally not highly valued and is confided to lowly qualified (poorly motivated) personnel, often in the context of subcontracting. These circumstances explain why design offices sometimes simplify their drawings, even if it entails renouncing optimization of the armature vis a vis requirements, to facilitate conformance at the time of execution.

Another, more recent, option is for the armatures to be made up from prefabricated armature sections which, after cutting, are laid on the part of the construction to be concreted and then completed by armature elements which either could not be part of the prefabricated sections or are used to assemble the various sections together. Of course, prefabrication in this way requires major installations located at a distance from the site, which makes this option feasible only if the prefabricated sections are made in panels conforming to the road transport load gauge (so that they can be transported and then cut on site) or precut in the workshop and then transported (provided of course that the precut sections themselves conform to the road transport load gauge). However, this option has the disadvantages that the possible number of meshes for the prefabricated sections is small and there is little choice as to the diameters of the rods used. Finally, it is somewhat difficult in management terms (procurement, assembly, etc).

Solutions have been proposed that attempt to combine flexibility in the design of the drawings and facility and reliability in the production of the armatures. In principle they are made in the workshop (road transport load gauge constraints therefore have to be taken into account, as already mentioned).

For example, document FR-2.629.390 teaches positioning the armature components in accordance with a predefined distribution schematic that corresponds in particular to the longitudinal distribution of the components or families of components, memorizing this schematic, reading the memory electronically and automatically transposing the data onto a medium for displaying the distribution of at least one component or family of components. This uses longitudinal rules provided with material markers, for example luminous (light-emitting diode) markers, having more than one state. However, this solution has the disadvantage of applying only to simple schematics involving longitudinal components having an imposed initial configuration (abutted against a crossmember) and transverse components which in principle must have fixed transverse positions. Furthermore, this solution does not remove the need for indirect marking out at the time of laying out the armature components.

The combination of the obligation to provide laying out drawings that are simple (but nevertheless conform to safety rules everywhere), the problems associated with the manual preparation operations or the additional costs imposed by the more rational solutions, leads to a penalty that some contractors have assessed at more than 8 kg per cubic meter of concrete.

When the armature elements or sections have been put into place, they are conventionally (see in particular document FR-2.691.996) assembled by:

binding with annealed iron wire, resistance welding, welding with filler metal.

Each of these assembly techniques has its own drawbacks:

binding with annealed iron wire is a manual operation with very low productivity, resistance welding requires an electrical power rating that increases very quickly in proportion to the dimension of the diameters to be assembled, manual welding using filler metal is a method where the dexterity of the operator is the fundamental factor conditioning the quality of the resulting assemblies.

As soon as the overall size of the armature exceeds 1 or 2 $m^2$, movements of the operators during assembly operations, which are in practice carried out flat on the ground, entail the risk of moving elements not yet fixed, which obliges each time a highly specific sequence of fixing the elements to guarantee at least two fixing points for elements likely to be moved during an assembly operation at a given point, even in a central portion of the armature. This leads to great complexity and therefore to risks of delays or errors.

An object of the invention is to alleviate the aforementioned drawbacks by means of a process, and an installation for implementing it, providing a simple, fast and nevertheless reliable way to prepare and assemble an armature for concrete, in strict conformance with a design drawing, regardless of the complexity of the drawing (whether it corresponds to a slab, a pre-slab or a vertical panel). Consequently, it is aimed at reducing the practical constraints that design offices have to take into consideration when determining an armature design drawing to allow better optimization of armatures allowing for strength of materials calculations.

To this end, the invention proposes a method of preparing and assembling a plane armature for a concrete product in accordance with a predetermined design drawing whereby elements of the armature to be made in accordance with the design drawing are laid out on a worksurface having two reference directions and the elements of the armature to be made are assembled two by two to obtain a plurality of crossover points, characterized in that this assembly operation is carried out subsequently to the laying out operation by an assembly tool fixed to the carriage of a robot having at least two degrees of freedom parallel to the reference directions, this method further including an operation of placing all of the data of the design drawing in a memory area of the robot and an operation of having the robot move the carriage automatically in accordance with said data.

In accordance with preferred teachings of the invention, optionally combined:

the assembly process is welding using a filler metal;

the carriage further has a degree of freedom in vertical translation and the assembly operation includes a sub-operation of moving the assembly tool successively to each assembly point on the design drawing;

the carriage further has a degree of freedom in rotation;

an optical sensor fastened to the tool monitors a surveillance field around a localized working area of said tool and the robot corrects the configuration of the carriage if this localized working area is offset from an area of crossover between armature elements detected in the surveillance field to eliminate this offset;

the optical sensor has a field of view intercepting on the worksurface an area with dimensions that are substantially equal to predetermined tolerances between real assembly points and theoretical points on the design drawing and an alarm is triggered if no crossover area is detected in the surveillance field and the tool is at an assembly point on the drawing;

the optical sensor checks the diameter of the armature elements to be assembled;

prior to the laying out operation, a full-scale drawing is drawn out on the worksurface indicating the location and the type from the design drawing for each element of the armature to be made, the laying out of these armature elements being effected at these locations in accordance with the specified types, this drawing out operation being performed by a drawing tool fixed to the carriage of a robot, this carriage having at least two degrees of freedom parallel to the reference direction, this method further including an operation consisting in placing all of the data of the design drawing in a memory area of the robot and an operation consisting in the robot moving the carriage automatically in accordance with said data;

the drawing tool is connected to a tank of ink or of paint the color of which represents a particular type of armature element;

the drawing tool is connected successively to tanks of ink or paint of respective colors representing a plurality of types of armature element;

the ink or paint from each tank is washable so that the worksurface can be reused;

the drawing and assembly operations are each carried out by a tool fixed to the carriage of the same robot;

the drawing and assembly operations are each carried out by tools fixed to carriages of different robots;

the different robots have different working areas and the worksurface is moved in succession to a working area of the drawing robot, an area for laying out the armature elements and a working area of the assembly robot;

all of the data is loaded into memory by inserting a diskette into a diskette drive;

the drawing operation includes a shuttering drawing sub-operation.

The invention also proposes an installation for preparing and assembling a plane armature for a concrete product in accordance with a predetermined design drawing, including a worksurface having two reference directions and an assembly tool for assembling armature elements previously laid out on the worksurface at a plurality of crossover points, characterized in that it further includes, for the assembly tool, a robot including a memory area adapted to contain all of the data of the design drawing and a carriage carrying said assembly tool having at least two degrees of freedom parallel to the reference directions and adapted to be moved with said assembly tool by the assembly robot in accordance with all of the data from the memory area.

In accordance with other preferred teachings of the invention, optionally combined:

the assembly tool is a welding device using a filler metal;

the carriage further has a degree of freedom in vertical translation;

the carriage further has a degree of freedom in rotation;

the carriage further carries vision equipment fastened to the tool and having a surveillance field around a localized working area of said tool, the robot incorporating software for correction by the robot of the configuration of the carriage if this localized area of action is offset from an area of crossover between armature elements detected in the field of surveillance to eliminate this offset;

the vision equipment has a field of view intercepting on the worksurface an area having dimensions substantially equal to predetermined tolerances between real assembly points and theoretical points on the design drawing and is adapted to trigger an alarm if no crossover area is detected in the field of surveillance and the tool is at an assembly point on the drawing;

it further includes a drawing tool for drawing out on the worksurface a full-scale drawing indicating the layout and the types according to the design drawing for each element of the armature to be assembled and a carriage carrying said drawing tool having at least two degrees of freedom parallel to the reference directions and adapted to be moved with said drawing tool by the drawing robot in conformance with all the data from the memory area;

the drawing tool includes a tank of ink or paint the color of which is chosen to represent a particular type of armature element;

the installation includes tanks of ink or paint for the drawing tool having respective colors representing various types of armature element;

the installation further includes a tank of ink or paint for a shuttering drawing;

the ink or paint from each tank is washable so that the worksurface is reusable;

the drawing and assembly tools are each fixed to the carriage of the same robot;

the drawing and assembly tools are each fixed to carriages of different robots;

the different robots have different working areas, the worksurface being provided with displacement means enabling it to move from the working area of the drawing robot to the working area of the assembly robot via an area for laying out the armature elements;

the robot includes a gantry mobile longitudinally along its working area and the carriage is mobile on this gantry transversely to this working area;

the robot has a dimension parallel to its direction of movement less than its dimension transversely to this direction of movement and to the maximal width of the road transport load gauge.

It will be realized that, among other things, the invention:

eliminates the marking out and drawing or verification times needed for laying out or assembling a set of armatures; this represents an increase in productivity in the order of 20 to 25% of the total assembly time; it also eliminates any errors associated with the calculation and with the manual measurement or checking of the spaces;

reduces the reinforcing rod assembly times;

covers welding of all reinforcing rod diameters, including large reinforcing rods (diameter from 10 to 56 mm or more);

guarantees the strength of the assembly;

guarantees conformance of the assembled armatures with the specifications;

reduces handling times;

automatically checks, immediately prior to assembly, conformance to the armature positioning tolerances and conformance to the ironwork drawing of the armatures laid out by the operators;

improves safety by reducing handling and eliminating exposure of operators to the ionizing radiation generated by the welding arc.

Objects, features and advantages of the invention will emerge from the following description given by way of non-limiting example with reference to the accompanying drawings in which.

Figure 7A:
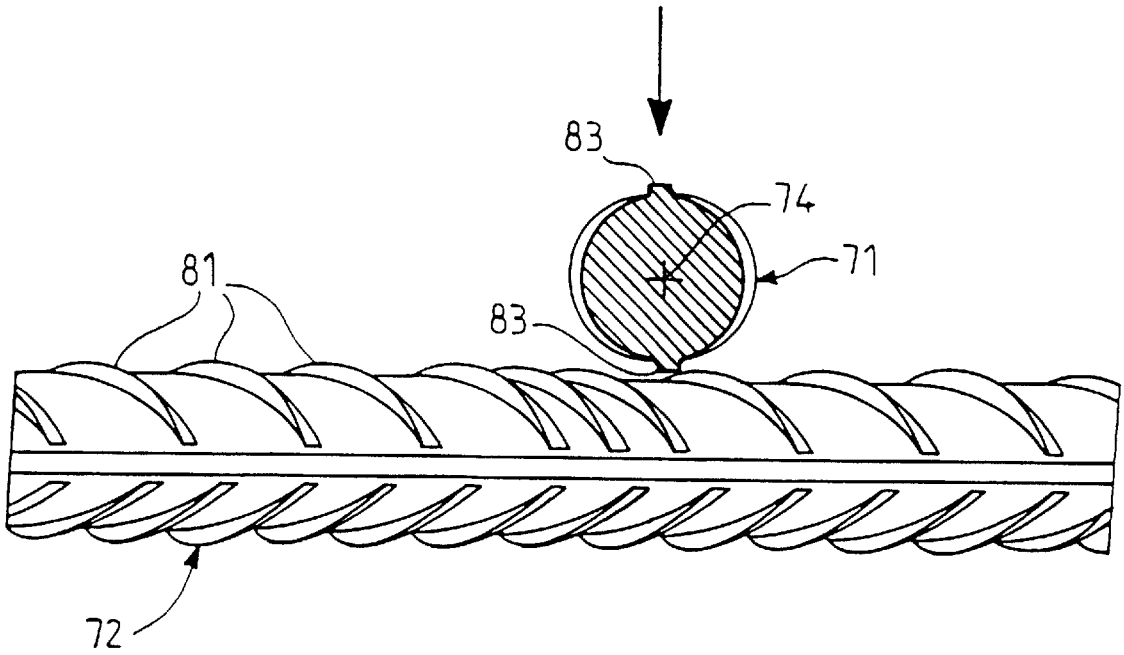
Figure 7B:
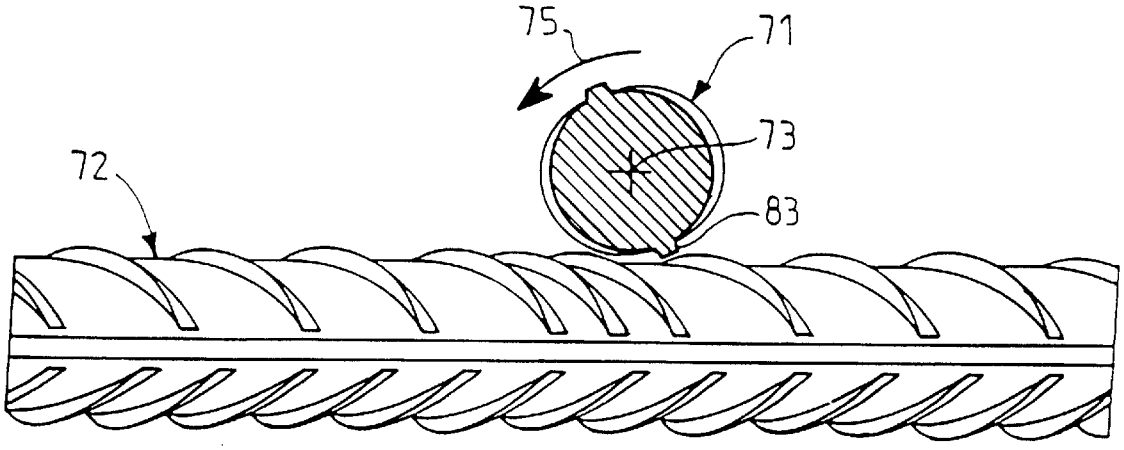
Figure 8:
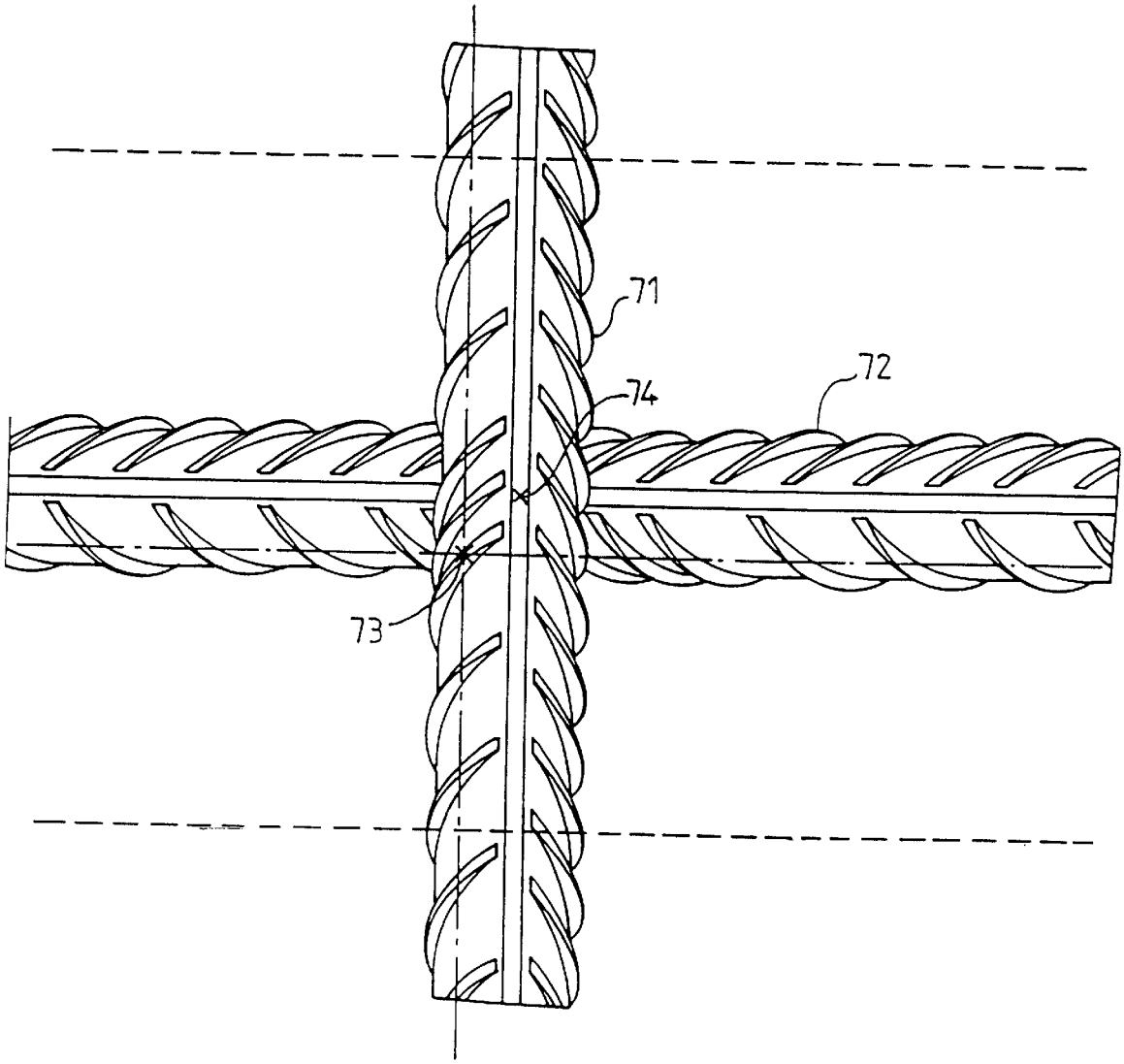

FIGS. 7*a* and 7*b* represent the kinematics of laying out a reinforcing rod that "rolls";

FIG. 8 shows the scanning field of the optical sensor; and

Figure 9:
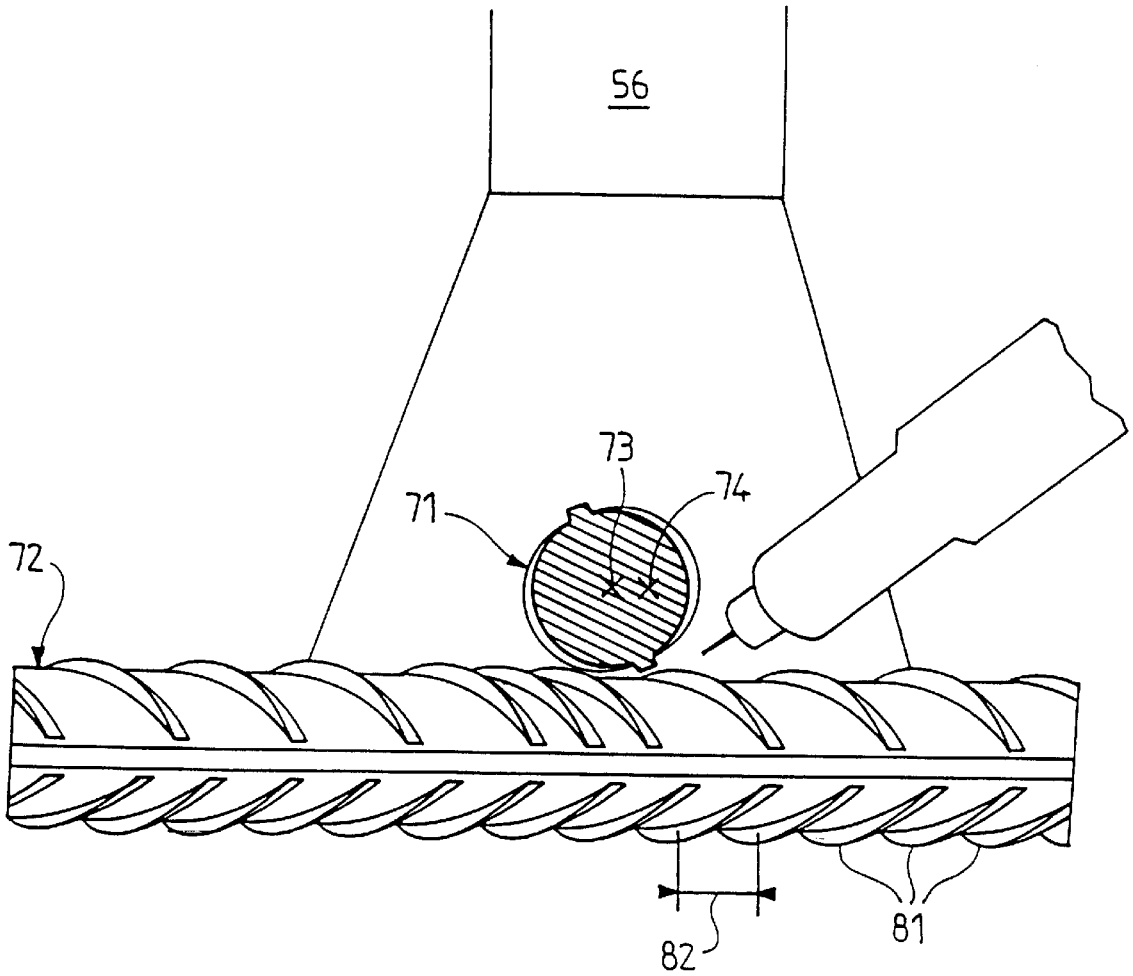

FIG. 9 shows the field of the optical sensor with the end of the welding gun.

With the invention, the drawing of the panel of armatures can be drawn out directly from the drawing established by the design office using a computer-aided drafting (CAD) system of any appropriate type known in itself dedicated to the armatures.

As an alternative to this, the information is captured on site using a CAD system.

The laying out of the armatures during the production of the drawing by the CAD system is advantageously effected with the aid of particular points on the shuttering (concrete edges, reserved areas, locations of integral metal parts). Conformance to the shuttering drawing being verifiable in detail, a full-scale drawing of the armatures made by a robot designed for this purpose is all that is required for laying out the armatures perfectly in conformance with the shuttering drawings.

The drawing robot is a gantry for drawing the layout of the armatures to be laid out to form the panel, for example.

This robot is in the form of a rolling gantry the all-welded chassis of which simultaneously provides a frame, supports transverse guides with its drawing unit and natural fairing of mechanical transmissions and on-board equipment. Its width is adapted to individual circumstances according to the width of the panels to be produced.

Distances along the longitudinal axis can be measured either by a smooth large diameter wheel equipped with cleaning devices installed between the two drive wheels and rolling on the reference rail or by a toothed wheel also installed between the two wheels and meshing with a rack running along the track.

The transverse axis is materialized by two precision guides the length of which is appropriate to the width of the panels and between which a carriage mounted on precision rollers moves. Measurements along this axis are taken directly from the motor drive, there being no slip in the drive.

The drives of the two axes are of the robot type and the transmissions use notched belts enabling the drawing robot to draw oblique lines and curves with great precision.

The drawing is made in a water-based paint having the specific property of being highly visible whilst adhering permanently to the work surface.

Automatic control is provided by a central processor unit integrated into the chassis of the drawing robot. This unit stores the instructions for drawing the panels in the HPGL format and controls all manual and automatic functions.

Data transfer is by means of rigid magnetic cards or via a serial link.

The electrical power supply is provided via a cable spooler.

The site foreman receives from the design office a memory card containing the data for drawing out the full-scale drawing required for producing the armatures of the panel to be assembled and inserts the card into the card reader of the drawing robot. The site foreman transfers the data into the memory of the drawing robot. The drawing robot is then operational.

The site foreman places the drawing robot at the start of the full-scale drawing using the manual controls. The drawing robot can then be started.

The armatures are laid out by operators in accordance with the armature drawing made by the drawing gantry. The production of the full-scale drawing enables rapid visual checking of the shape parameters of the armature just placed.

In a preferred method of the invention, when the diameter of the reinforcing rods specified by the drawing and the parts list allows, the reinforcing rods come from an unspooler-straightener-shaper installed near the working plate, from reinforcing rods supplied on spools. The characteristics of the reinforcing rods (length, shape, . . . ) are obtained directly from the parts list established by the CAD system.

Where the armature characteristics do not allow this, the reinforcing rods are cut and shaped in traditional workshops.

The characteristics of the armatures can be obtained directly from the computer-generated parts list for the drawing established by the CAD system with no further data entry.

In a preferred method of the invention, the reinforcing rods are welded using filler metal. As for drawing, the welding gun is guided by information from the data processing system that made the drawing for the armatures. A digital vision system (or, more generally, an optical sensor capable of shape recognition) corrects the trajectory of the welding gun in order to adapt the position of the welding gun relative to the intersection to be bonded (torch/point distance, angle of approach, arc impact point). Displacement of the carriage in two horizontal directions is preferably complemented by rotation about a horizontal axis. There is also a vertical movement at each joint to be effected.

A control system controls the welding system and the optical sensor. The optimal welding parameters (gun angle, welding current, feed rate of the cored welding wire, etc) are deduced from the diameters of the reinforcing rods constituting the intersection and identification of the precise position of the reinforcing rods.

This self-adaptive capability of the welding system enables quality welding of the reinforcing rods, regardless of their diameter and despite the shape parameters of the reinforcing rods (height, separation, length, inclination of locks or imprints) that lead to a natural displacement of the reinforcing rod relative to the theoretical position on the drawing.

The digital vision system (or the optical sensor) is adjusted so that the intersections of the reinforcing rods are welded only within the tolerances defined by the reinforced concrete calculation regulations, or even within closer tolerances required for a particular construction.

Figure 1:
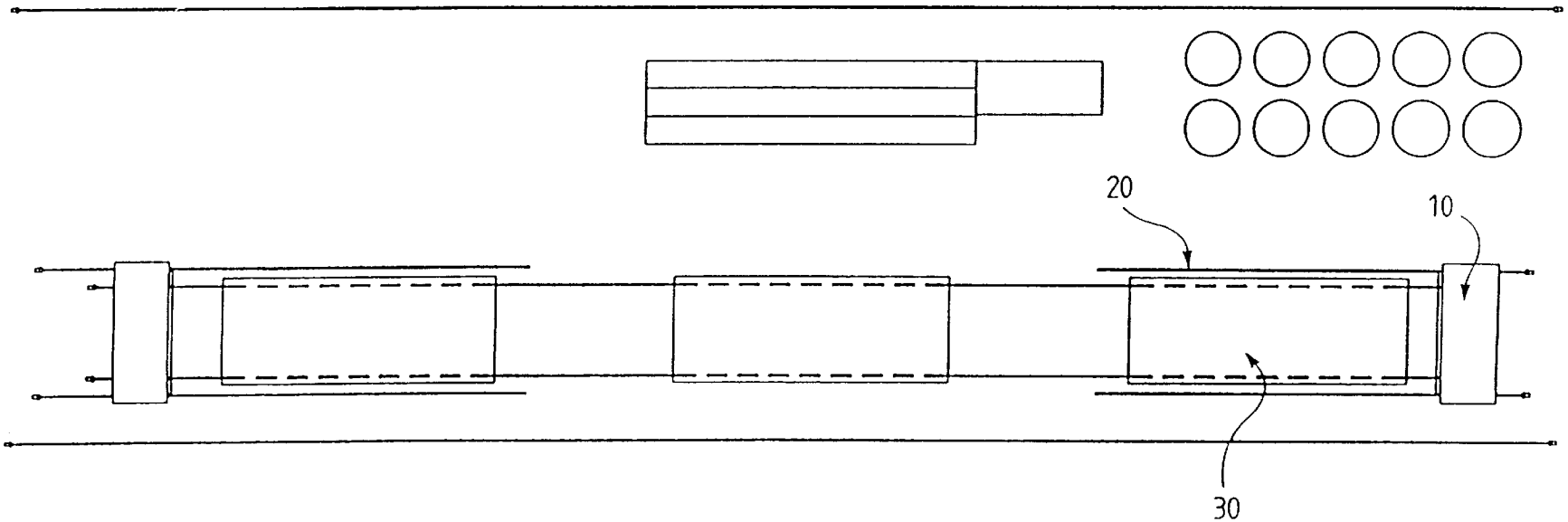
FIG. 1 is a plan view of one possible installation in accordance with the invention for preparing and assembling armatures.
Figures 5A, 5B, 5C:
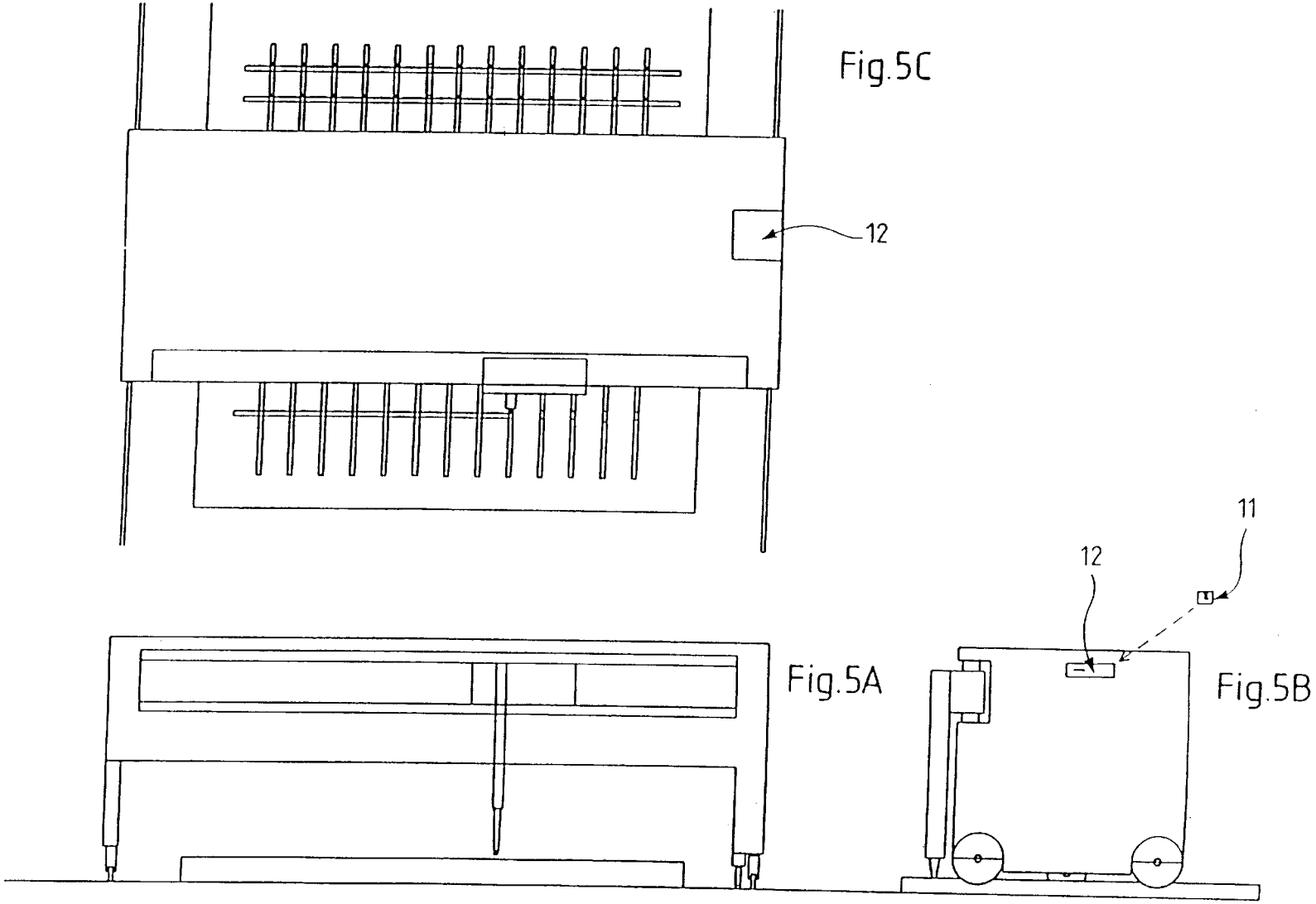
FIGS. 5A, 5B, 5C represent the drawing robot as seen from the front, from the side and from above.

A workstation for jointing reinforcing rods is shown in FIG. 1. The drawing gantry for the armatures 10 is positioned at the start of its rolling track 20 to enable it to cover a worksurface 30. The site foreman inserts the computer diskette 11 into a diskette drive connected to the central processor unit 12 (FIG. 5) integrated into the chassis of the gantry. The computer diskette 11 contains data for drawing out the armature drawing established by the CAD software. After the data is transferred from the diskette into a memory of the central processor unit, the site foreman removes the diskette. The drawing gantry is then operational.

Figure 2:
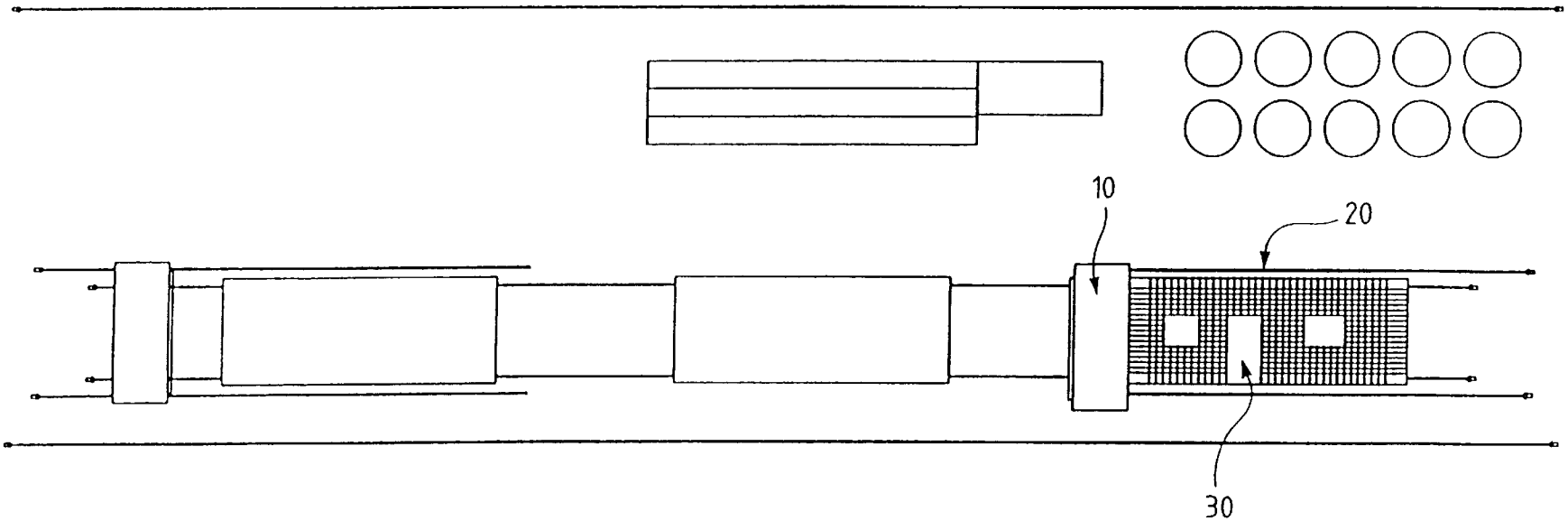
FIG. 2 is a plan view of a first working phase, i.e. the full-scale drawing out of the position of the armatures by the gantry.

In FIG. 2, the drawing gantry 10 at the end of its rolling path 20 has marked out the future positions of the armatures on the worksurface 30.

Figure 3:
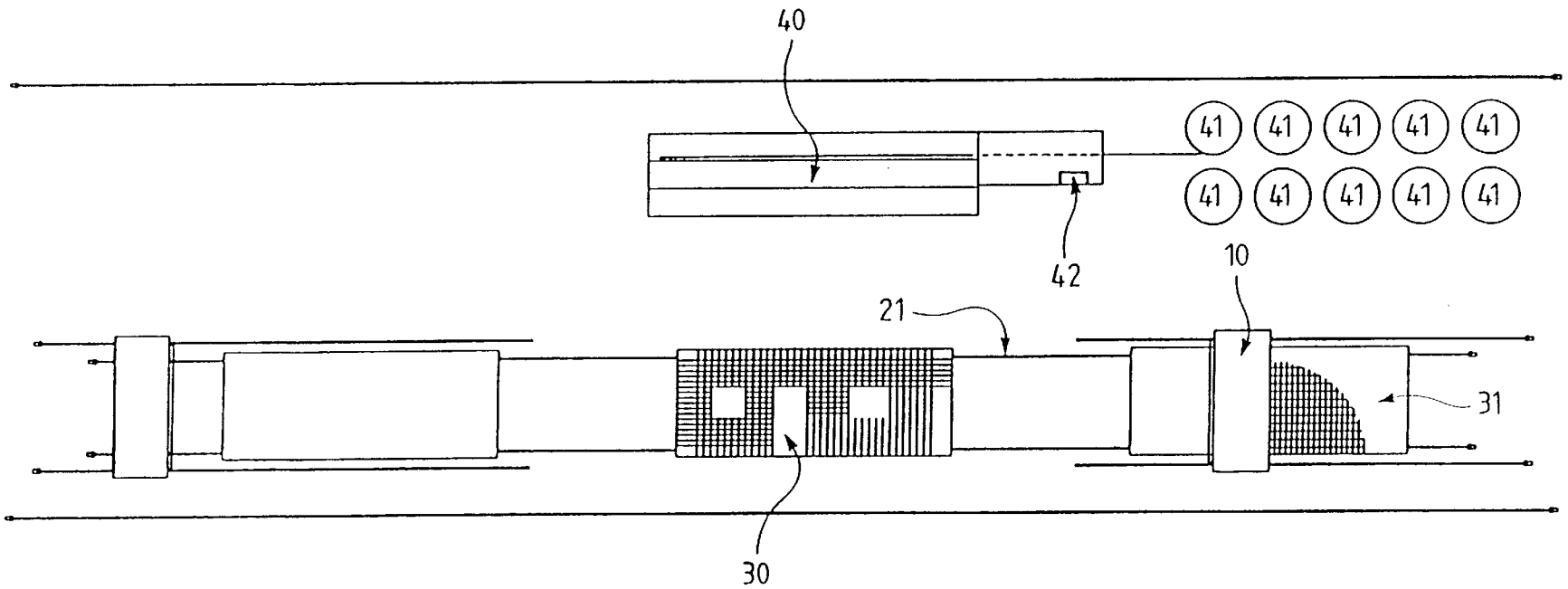
FIG. 3 is a plan view of the second working phase, i.e. the laying out of the armatures in accordance with the preceding phase.

In FIG. 3, the worksurface 30 has been moved to the area where the armatures will be laid out in accordance with the drawing effected by the gantry 10. In a preferred embodiment, the worksurface is fixed to roller skates that move along the rolling path 21.

In one particular example of the station of the invention for making up armatures, when their characteristics allow, the reinforcing rods are obtained from spools 41 by means of a straightening-cutting-shaping device 40. The shape characteristics of these rods can be obtained from the diskette 11 and loaded into a central processor unit 42 controlling the straightener-cutter-shaper without further data entry being necessary. After the data is loaded, the gantry 1 draws out another armature element on the plate 31.

Figure 4:
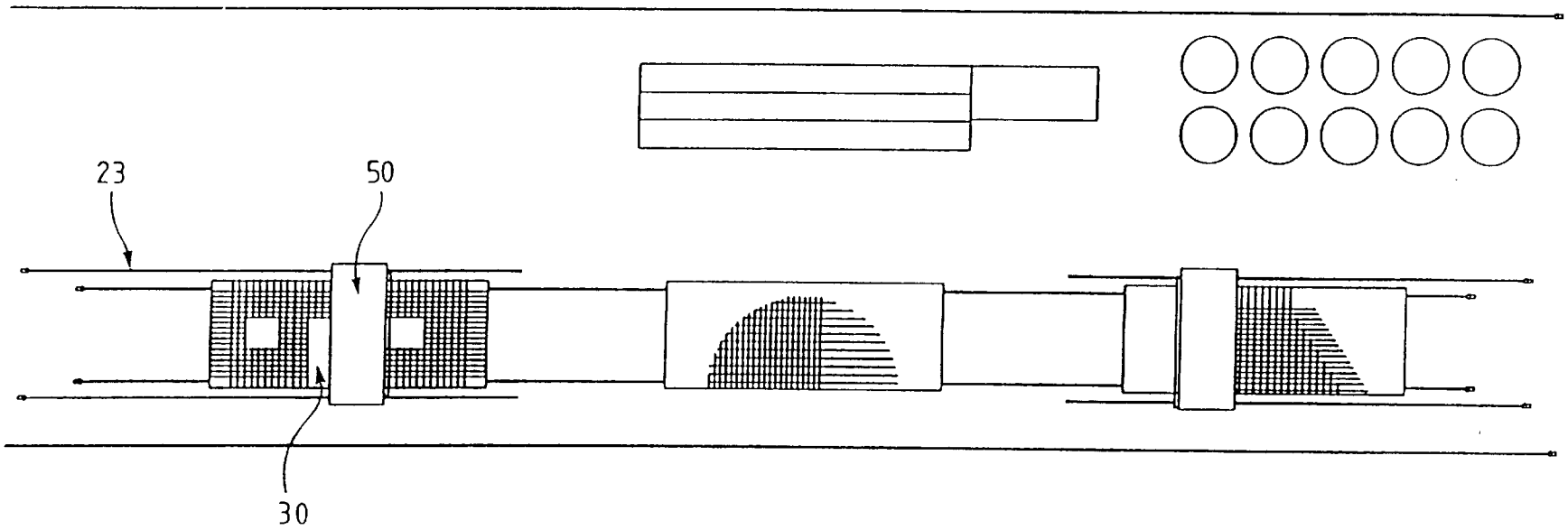
FIG. 4 is a plan view of the third working phase, i.e. the welding of the armatures by the welding robot gantry.

In FIG. 4, the plate 30 has been moved into the working area of the welding gantry 50 which can move along the rolling path 23.

The possibility of moving the worksurface 30 from the area where the armatures are laid out to the working area of the gantry 50 and vice versa makes it possible to assemble layers with more than two beds. For example, after assembling the first two beds, the worksurface is moved back to the laying out area for laying out a third bed that will be assembled to the second bed after movement to the working area of the gantry 50. It is also possible to lay out a second layer on the first, this second layer being supported by layer spacers, and then to link the two layers by pins, the pinheads being welded using filler metal after moving the worksurface 30 into the working area of the gantry 50 again.

Figures 6A, 6B, 6C:
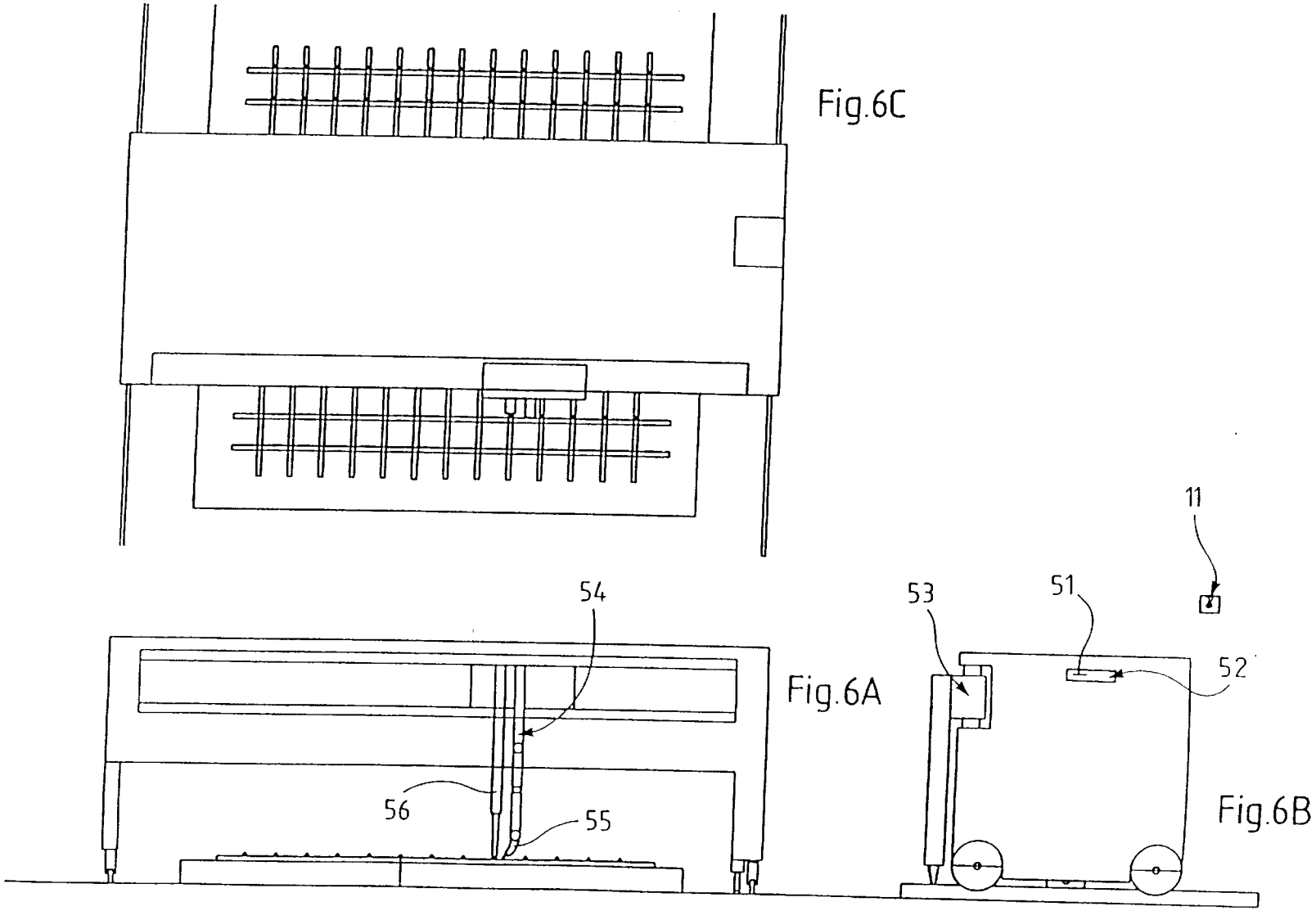
FIGS. 6A, 6B and 6C show the welding robot as seen from the front, from the side and from below.

The computer diskette 11 carrying the data from the CAD system is inserted into the diskette drive 51 of the central processor unit 52 (FIG. 6).

The data transmitted guides the mobile assembly 53 including an arm 54 pivoted about four axes supporting a welding gun 55 and an optical sensor 56.

The trajectory of the mobile assembly 53 is controlled by the data from the CAD system, preferably in accordance with the drawing out of the upper reinforcing rods.

At the intersections (see FIGS. 7*a,* 7*b,* 8 and 9), the optical sensor 56 scans the positions of the top reinforcing rod 71 and the bottom reinforcing rod 72 and then compares their respective real position 73 (identified by the sensors) with their theoretical position 74 given by the data contained in the computer file generated by the CAD system.

The shape parameters of the reinforcing rods:

height of ridges 81, separation of ridges 82, length of ridges, orientation, on laying out, of ribs 83, dimensions of these ribs, cause rotation 75 of the reinforcing rod, displacing the reinforcing rod relative to the theoretical position on the drawing. In parallel with this, the optical sensor 56 measures the diameter of the reinforcing rod 71 and that of the lower reinforcing rod 72 constituting the intersection. It is important to notice here that in practise rolling of the rods on laying them out depends on many parameters and is therefore in practise impossible to model.

The optical sensor 56 also compares these measured diameters with the theoretical diameters of these reinforcing rods given by the data contained in the computer file of the plane of the armature element created by the CAD system and transferred into the central processor unit 52 of the welding robot.

The system is programmed so that the welding can be effected only if the diameters conform to the drawing and the positions of the reinforcing rods constituting the intersection is within defined execution tolerances. At this time, the optical sensor 56 acquires the profile of the intersection. Analysis enables the optimum welding parameters to be deduced, followed by adaptation of the trajectory of the welding gun for an optimal position of the welding gun relative to the intersection to be welded (torch/point distance, angle of approach, arc impact point).

The invention constitute a great improvement over the existing technique in providing a device for fabricating reinforced concrete armature elements enabling assembly with very great flexibility (so that the drawings can likewise feature great flexibility), with the possibility of fabrication in shop or on site to the same quality conditions, because of the use of computer-based self-checking.

It will be understood that the invention uses elements that individually are known in themselves.

For example:

the vision system is generally an optical sensor: it is, for example, the laser triangulation optical sensor sold by the Canadian company SERVOROBOT under the name SPOT, the gantries are, for example, of the type used in another application, namely ROBOTRACE gantries of the French company ARIA (Automatismes Robotiques Informatiques Appliqués) of Avignon, the programs controlling the operation of the robots will be obvious to the skilled person, using programming utilities and the information given hereinabove.

It goes without saying that the invention is not limited to the production of flat panels only, but applies equally to the fabrication, under the same conditions, of curved panels or panels of other shapes, with the use of negatives or conventional bending systems. Likewise, productivity concerns may indicate the mounting of a plurality of tools on one gantry.

What is claimed is:

1. Method of preparing and assembling a plane armature for a concrete product in accordance with a predetermined design drawing indicating assembly points, comprising steps of:

providing elements of the armature to be made in accordance with the design drawing;

laying out said elements on a work surface having two reference directions;

providing a robot with a carriage having at least two degrees of freedom parallel to the reference directions and one degree of freedom in rotation;

providing an assembly tool fixed to the carriage of said robot;

storing all data of the design drawing including data on said assembly points in memory of said robot;

assembling said elements two by two to obtain a plurality of crossover points, said assembling comprising steps of:

moving said carriage automatically in accordance with said data so as to move the assembly tool successively to each assembly point on the design drawing;

monitoring a surveillance field around a localized working area of said tool by an optical sensor fastened to the tool;

correcting the position of the carriage by said robot if the localized working area is offset from an area of crossover between armature elements detected in the surveillance field to eliminate this offset; and assembling said elements by welding using a filler metal.

2. Method according to claim 1, characterized in that the carriage further has a degree of freedom in vertical translation.

3. Method according to claim 1 characterized in that the optical sensor has a field of view intercepting on the work surface an area with dimensions that are substantially equal to predetermined tolerances between real assembly points and theoretical points on the design drawing and an alarm is triggered if no crossover area is detected in the surveillance field and the tool is at an assembly point on the drawing.

4. Method according to claim 1 characterized in that the optical sensor checks the diameter of the armature elements to be assembled.

5. Method of preparing and assembling a plane armature for a concrete product in accordance with a predetermined design drawing, comprising:

providing a work surface having two reference directions;

providing a drawing robot with a drawing tool fixed to a carriage of the robot, this carriage having at least two degrees of freedom parallel to the reference direction of the work surface;

storing all of the data of the design drawing in a memory area of the drawing robot and moving the carriage automatically in accordance with said data;

drawing out a full-scale drawing on said work surface indicating location and type of elements from the design drawing for each element of the armature to be made;

providing elements of the armature to be made in accordance with the design drawing;

laying out said elements on the work surface in accordance with identified locations and types;

providing an assembly robot having at least two degrees of freedom parallel to the reference directions and one degree of freedom in rotation;

storing all the data of the design drawing in memory of said assembly robot; and assembling said elements two by two to obtain a plurality of crossover points using an assembly tool fixed to a carriage of said assembly robot which carriage automatically moves the assembly tool successively to each assembly point on the design drawing in accordance with said data;

wherein the assembling is provided by welding using a filler metal and is carried out subsequently to the laying out operation, and the method further comprising sub-operations of monitoring a surveillance field around a localized working area of said assembly tool by an optical sensor fastened to the assembly tool and correcting the position of the carriage by said robot if the localized working area is offset from an area of crossover between armature elements detected in the surveillance field to eliminate this offset.

6. Method according to claim 5 characterized in that the drawing tool is connected successively to a plurality of tanks of ink or paint of respective colors representing a plurality of types of armature element.

7. Method according to claim 5, characterized in that the drawing and assembly operations are each carried out by a tool fixed to the carriage of the same robot.

8. Method according to claim 5 characterized in that the drawing robot and the assembly robot have different working areas and the work surface is moved in succession to a working area of the drawing robot, an area for laying out of the armature elements and a working area of the assembly robot.

9. Method according to claim 5 characterized in that all of the data is loaded into memory by inserting a diskette into a diskette drive.

10. Method according to claim 5 characterized in that the drawing operation includes a shuttering drawing sub-operation.

11. Method according to claim 5, characterized in that the drawing tool is connected to at least one tank of ink or of paint of a color which represents a particular type of armature element.

12. Method according to claim 11 characterized in that the ink or paint from each tank is washable so that the work surface can be reused.

13. Installation for preparing and assembling a plane armature for a concrete product in accordance with a predetermined design drawing, including a work surface having two reference directions, an assembly tool for assembling armature elements previously laid out on the work surface at a plurality of crossover points, a robot for the assembly tool including a memory area adapted to contain all of the data of the design drawing and a carriage carrying said assembly tool having at least two degrees of freedom parallel to the reference directions and one degree of freedom in rotation and adapted to be moved with said assembly tool by the assembly robot in accordance with all of the data from the memory area, wherein said assembly tool comprising a welding device using a filler metal and said carriage further carrying vision equipment fastened to the tool and having a surveillance field around a localized working area of said tool, the robot incorporating software for correction by the robot of the configuration of the carriage if this localized working area is offset from an area of crossover between armature elements detected in the surveillance field to eliminate this offset.

14. Installation according to claim 13 characterized in that the carriage further has one degree of freedom in vertical translation.

15. Installation according to claim 13 characterized in that the vision equipment has a field of view intercepting on the work surface an area having dimensions substantially equal to predetermined tolerances between real assembly points and theoretical points on the design drawing and is adapted to trigger an alarm if no crossover area is detected in the field of surveillance and the tool is at an assembly point on the drawing.

16. Installation according to claim 13 characterized in that the robot includes a gantry mobile longitudinally along its working area and the carriage is mobile on this gantry transversely to this working area.

17. Installation according to claim 16 characterized in that the robot has a dimension parallel to its direction of movement less than its dimension transversely to this direction of movement and to the maximal width of the road transport load gauge.

18. Installation according to claim 13 characterized in that it further includes a drawing tool for drawing out on the work surface a full-scale drawing indicating layout and types of elements according to the design drawing for each element of the armature to be assembled and a carriage carrying said drawing tool having at least two degrees of freedom parallel to the reference directions and adapted to be moved with said drawing tool by the drawing robot in conformance with all the data from the memory area.

19. Installation according to claim 18 characterized in that the drawing and assembly tools are each fixed to the carriage of the same robot.

20. Installation according to claim 18 characterized in that the drawing robot and the assembly robot have different working areas, the work surface being provided with displacement means enabling it to move from the working area of the drawing robot to the working area of the assembly robot via an area for laying out the armature elements.

21. Installation according to claim 18 characterized in that the drawing tool includes at least one tank of ink or paint the color of which is chosen to represent a particular type of armature element.

22. Installation according to claim 20 characterized in that the installation further includes a tank of ink or paint for a shuttering drawing.

23. Installation according to claim 20 characterized in that the ink or paint from each tank is washable so that the work surface is reusable.

* * * * *